US012791015B2

(12) United States Patent
Casello et al.

(10) Patent No.: US 12,791,015 B2
(45) Date of Patent: Nov. 10, 2026

(54) MONITORING THE PERFORMANCE OF A CRYOPUMP

(71) Applicant: Edwards Vacuum LLC, Sanborn, NY (US)

(72) Inventors: John Casello, Chelmsford, MA (US); Mark Steven Collins, Chelmsford, MA (US); Charles Hamilton Young, Chelmsford, MA (US)

(73) Assignee: Edwards Vacuum LLC, Sanborn, NY (US)

( * ) Notice: Subject to any disclaimer, the term of this patent is extended or adjusted under 35 U.S.C. 154(b) by 0 days.

(21) Appl. No.: 18/252,610

(22) PCT Filed: Nov. 17, 2021

(86) PCT No.: PCT/IB2021/060663
§ 371 (c)(1),
(2) Date: May 11, 2023

(87) PCT Pub. No.: WO2022/112903
PCT Pub. Date: Jun. 2, 2022

(65) Prior Publication Data

US 2023/0407858 A1 Dec. 21, 2023

(30) Foreign Application Priority Data

Nov. 25, 2020 (GB) ..... 2018534

(51) Int. Cl.
*F04B 37/08* (2006.01)
*F04B 49/06* (2006.01)
*F04B 51/00* (2006.01)

(52) U.S. Cl.
CPC ..... *F04B 37/085* (2013.01); *F04B 49/065* (2013.01); *F04B 51/00* (2013.01)

(58) Field of Classification Search
CPC ..... F04B 37/085; F04B 49/065; F04B 51/00
See application file for complete search history.

(56) References Cited

U.S. PATENT DOCUMENTS 4,958,499 A 9/1990 Haefner et al.
6,272,400 B1 * 8/2001 Jankins ..... F04B 49/065 700/282

(Continued)

FOREIGN PATENT DOCUMENTS

EP 0336992 A1 10/1989
KR 20180048290 A * 5/2018 ..... H10P 72/0612
WO 9002878 A2 3/1990

OTHER PUBLICATIONS

English translation of KR 10-2018-0048290 (Year: 2018).*

(Continued)

*Primary Examiner* — Connor J Tremarche
(74) *Attorney, Agent, or Firm* — Theodore M. Magee; Westman, Champlin & Koehler, P.A.

(57) ABSTRACT

A method of monitoring the performance of a cryopump, the circuitry for monitoring the performance and the cryopump are disclosed. The method comprises: following completion of a regeneration cycle controlling said cryopump to perform a predetermined test routine for testing a performance of said cryopump under predetermined conditions; monitoring said cryopump during said predetermined test routine to collect data indicative of said performance of said cryopump; storing data collected during said monitoring.

5 Claims, 2 Drawing Sheets

(56) References Cited

U.S. PATENT DOCUMENTS 6,330,525 B1 * 12/2001 Hays ..... F04D 15/0088 702/182
6,902,378 B2 * 6/2005 Gaudet ..... F04B 49/065 417/27

2001/0012485 A1 8/2001 Gaudet et al.
2002/0074324 A1 * 6/2002 Wang ..... C30B 25/16 219/390
2009/0282842 A1 * 11/2009 Koyama ..... F28F 9/0282 62/172
2012/0317999 A1 12/2012 Koyama
2015/0267693 A1 * 9/2015 Oikawa ..... F04B 37/085 62/55.5
2016/0245270 A1 8/2016 Yatsu
2019/0353156 A1 * 11/2019 Ward ..... F04B 49/065
2020/0132064 A1 * 4/2020 Takahashi ..... F04B 49/065

OTHER PUBLICATIONS

PCT Notification of Transmittal of the International Search Report and the Written Opinion of the International Searching Authority, or the Declaration, PCT International Search Report and PCT Written Opinion dated Jan. 27, 2022 for corresponding PCT application Serial No. PCT/IB2021/060663, 11 pages.
British Examination Report dated Apr. 26, 21 for corresponding British application Serial No. GB2018534.4, 1 page.
British Search Report dated Apr. 21, 21 for corresponding British application Serial No. GB2018534.4, 1 page.
Chinese Search Report dated May 31, 2025 for corresponding Chinese application Serial No. 202180079492.6, 3 pages.

* cited by examiner

MONITORING THE PERFORMANCE OF A CRYOPUMP

CROSS-REFERENCE TO RELATED APPLICATION

This application is a Section 371 National Stage Application of International Application No. PCT/IB2021/060663 filed Nov. 17, 2021, and published as WO 2022/112903 A1 on Jun. 2, 2022, the content of which is hereby incorporated by reference in its entirety and which claims priority of British Application No. 2018534.4, filed Nov. 25, 2020.

FIELD

The field of the invention relates to cryopumps and to a method and circuitry for monitoring the performance of a cryopump.

BACKGROUND

Cryopumps work on the principle of condensing or trapping the gases to be pumped. This means that the cryopump needs to be periodically regenerated to remove the trapped gas. Regeneration involves isolating the pump from the vacuum system and warming the pump up while introducing purge gases to dilute the trapped gas that is desorbed or vapourised by the warming.

If a cryopump/system is not performing to its specifications and is degrading slowly but without affecting the customer process it could fail unexpectedly. This can be extremely expensive for the user of the cryopump, especially if the cryopump is being used for a process such as integrated circuit manufacturer.

It would be desirable to provide a method and/or diagnostic system able to monitor the current health or performance of a cryopump and to determine pump degradation and thus, predict future poor performance or failures. An ability to predict performance degradation allows a service engineer to intervene prior to the degradation impacting unduly on the process being pumped.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a method of monitoring the performance of a cryopump, said method comprising: following completion of a regeneration cycle controlling said cryopump to perform a predetermined test routine for testing a performance of said cryopump under predetermined conditions; monitoring said cryopump during said predetermined test routine to collect data indicative of said performance of said cryopump; storing said data indicative of said pump collected during said monitoring.

Cryopumps are periodically regenerated to remove the accumulated condensed gases. This is done while the pump is not being used to pump a vacuum chamber so that during regeneration the pump is generally under the control of control circuitry associated with the pump rather than being actively used for cryopumping process gasses in the vacuum chamber. Furthermore, the gate valve to the vacuum chamber is closed.

Furthermore, once the regeneration cycle has completed the state of the pump is known and the gate valve to the vacuum chamber evacuated by the pump is closed. This therefore provides a period which is ideal for the execution of a test routine, as the vacuum system evacuated by the pump will not be affected and the condition of the pump is known. Thus, the behaviour of the pump during a test routine executed at this time will be indicative of the pump's current performance and is independent of the vacuum system it evacuates and any collected condensed material. This means that any comparison of a current test with previous tests which have been performed under near identical conditions will provide an accurate picture not only of the current health of the pump but also an indication of how this health or performance has changed over time. Additionally, as regeneration occurs periodically this provides opportunities to perform these tests regularly and thus, any degradation of the pump can be regularly monitored.

In some embodiments, said method controls said cryopump to perform said predetermined test routine periodically after at least a subset of said regeneration cycles.

In order to monitor degradation of the pump and to be able to predict pump failure before it happens, it is preferable that any pump testing routine is performed regularly. As regeneration cycles are performed periodically the test routine may be performed after a certain proportion of these regeneration cycles, perhaps after each regeneration cycle or perhaps after alternate regeneration cycles.

In some embodiments, the method comprises a further step of determining said performance of said pump from said collected data.

The data collected is indicative of the current performance of the pump, and the method may analyse the data to determine the performance.

In some embodiments said step of determining said performance of said pump comprises comparing data obtained from a current test routine with data obtained from previous test routines.

The absolute value of data obtained from a test routine is indicative of the pump's current performance and comparing the data with data of other earlier test results, provides an effective indication of any changes in the pump's performance and indeed the rate change of the pump's performance and thus, may be helpful in providing a prediction of when a pump may fail.

In some embodiments, said method comprises a further step of outputting data indicative of said pump performance.

The data collected may be output. It may be output as raw data or as processed data, in some embodiments as an indicator indicative of the pump's performance. The indicator may be accessible to the pump operator. The indicator may be in the form of a numerical performance indication, or a colour coded indication. Where the performance is determined to be low the indicator may indicate that a service engineer's input is desirable. The pump performance indicator may be generated in response to the collected data values and/or to changes in the collected data values when compared to those collected during pervious tests. Changes in the collected values indicate a deterioration in the performance of the pump and provide a basis for predicting a future performance of the pump, allowing the pump to be replaced before it fails or its performance degrades unduly.

In some embodiments, said step of outputting said data comprises receiving a request for said data and outputting said data in response to said request.

The request may be from a service engineer at the site of the pump and the data may be output via a port on the pump, or it may be a request from a remote server and the data may be output across a network to the remote server.

In some embodiments, said predetermined test routine comprises determining a level of cooling provided by said cryopump at a predetermined motor speed.

The predetermined test routine is a routine where the pump operates in a predetermined way and the performance of the pump is measured. In some cases the test routine may comprise the cryopump operating with a constant predetermined motor speed and the level of cooling provided by the cryopump at this motor speed may be measured. In this regard, the cryopump may have a variable speed motor which pumps refrigerants such a helium gas around the refrigerating system. The speed of the motor affects the speed that the refrigerant is pumped around the system and thus, the cooling capacity that the system can provide. When the motor speed is set to a constant value then the cooling capacity at this speed is indicative of the current performance and effectiveness of the cryopump. Thus, running the motor at a predetermined speed and determining how much cooling is then provided by the cryopump is an indicator of the performance of the pump.

In some embodiments, said step of controlling said cryopump to perform a predetermined test routine comprises: controlling a variable speed motor controlling a flow of refrigerant through a refrigerating system of said cryopump to operate at a predetermined speed; setting a first predetermined temperature for a first stage of a refrigerator and a second predetermined temperature for a second stage of said refrigerator; and controlling heaters associated with said first and second stages of said refrigerator such that said first and second predetermined temperatures are maintained; and said step of determining the performance of said cryopump comprises determining power applied to said heaters maintaining said first and second predetermined temperatures.

One way of determining the level of cooling provided by the cryopump may be by setting a predetermine temperature for the first stage and the second stage of the refrigerator, in some cases these predetermined temperatures may be selected to be the normal temperature of operation of the cryopump, and determining the power consumed by heaters associated with these stages of the refrigerators to maintain these temperatures. The level of cooling provided by the cryopump is a function of the power applied to the heaters. In this regard, as the cyropump's performance deteriorates over time then the cooling provided by the pump decreases and the amount of power applied to the heaters to maintain the temperatures will also decrease and be indicative of this deterioration in performance.

In some embodiments, the method comprises a further step of receiving an input indicative of at least one of said predetermined temperatures and said predetermined motor speed, said method being configured to perform subsequent test routines using said received at least one of said predetermined temperatures and motor speed.

In some embodiments, a service engineer may be able to update the predetermined temperatures and/or motor speeds of the test where it may be desirable to change the testing conditions perhaps to reflect the current or future conditions of use of the cryopump.

A second aspect provides a computer program comprising computer readable instructions which when executed by a processor control said processor to perform steps in a method according to a first aspect.

A third aspect provides control and diagnostic circuitry for a cryopump, said control circuitry being configured to determine when a regeneration cycle has completed and to control said cryopump following completion of said regeneration cycle to perform a predetermined test routine for testing a performance of said cryopump under predetermined conditions; and said diagnostic circuitry is configured to: monitor said performance of said cryopump during said predetermined test routine; and store data indicative of said performance obtained from said monitoring.

In some embodiments, said control circuitry is configured to control said cryopump to perform said predetermined test routine periodically after at least a subset of said regeneration cycles.

In some embodiments, said diagnostic circuitry is configured to determine a performance of said pump from said collected data.

In some embodiments, said diagnostic circuitry is configured to determine said performance of said pump by comparing data obtained from a current test routine with data obtained from previous test routines.

In some embodiments, said diagnostic circuitry is configured to output an data indicative of a performance of said pump.

In some embodiments, said diagnostic circuitry is configured to output said data in response to receiving a request for said data.

In some embodiments, said predetermined test routine comprises determining a level of cooling provided by said cryopump at a predetermined motor speed.

In some embodiments, said control circuitry is configured to control said cryopump to perform said predetermined test routine by: controlling a variable speed motor controlling a flow of refrigerant through a refrigerating system of said cryopump to a operate at a predetermined speed; setting a first predetermined temperature for a first stage of a refrigerator and a second predetermined temperature for a second stage of said refrigerator; and controlling heaters associated with said first and second stages of said refrigerator such that said first and second predetermined temperatures are maintained; and said diagnostic circuitry is configured to determine a power applied to said heaters maintaining said first and second predetermined temperatures.

A fourth aspect provides a cryopump comprising: a refrigerator unit; a variable speed motor for controlling a flow of refrigerant through a cooling system of said cryopump; and control and diagnostic circuitry according to a third aspect.

In some embodiments, said refrigerator unit comprises a two stage refrigerator; and said cryopump further comprises: a temperature sensor for monitoring a temperature of said first stage of the refrigerator and a temperature sensor for monitoring a temperature of said second stage of the refrigerator; and a heater for supplying heat to said first stage and a heater for supplying heat to said second stage of the refrigerator.

In some embodiments, the control circuitry is further configured to control the regeneration of the pump.

The regeneration cycles performed by the pump will be under the control of control circuitry associated with the pump and this same control circuitry may be used to control execution of the test routine.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The summary is provided to introduce a selection of concepts in a simplified form that are further described in the detailed description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1:
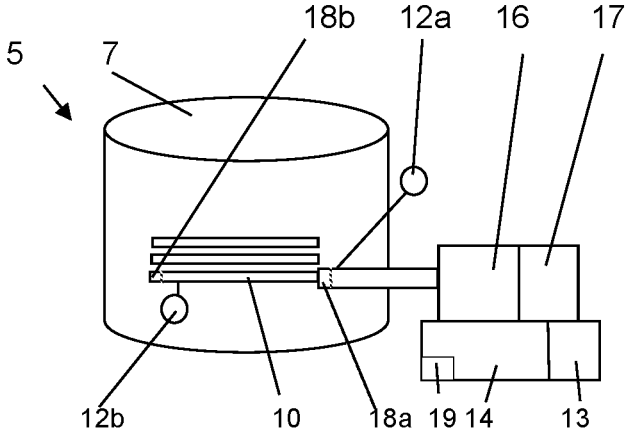
FIG. 1 shows a cryopump, and control and diagnostic circuitry according to an embodiment.

Before discussing the embodiments in any more detail, first an overview will be provided.

Embodiments provide a software-based function that is able to help determine a pump's ability to perform in a customer's operational environment. The software-based function controls the pump to perform a diagnostic test following a regeneration cycle and the information collected during the periodic diagnostic tests may be made available to service engineers to help determine the current refrigeration capacity of the pump.

In some embodiments, the cryopump comprises a variable speed motor and is configured to be operated at several operating RPM's including 72 rpm and several operating 1st and 2nd stage temperatures including 65K, 13.5K. During the test routine the pump may be controlled to operate at this fixed operating state 1st and 2nd stage temperatures typically being 65, 13.5 K and motor 72 RPM, and there will be a resulting amount of heater power applied to heaters which may be measured as a % of a maximum amount or actual watts. These power measurements are the indicator of the available refrigeration capacity and thus, the performance of the cryopump.

In some embodiments, a new pump will be tested with the test routine and the results compared with the results of subsequent test routines performed after each regeneration on the customer's tool. The results from the production test and first regeneration will be used as a baseline to monitor the pump's performance after each cooldown to keep a running trendline of performance.

The cryopump will be regenerated in the usual way and then within the "cooldown" phase of the set routine it is may be "health checked" by performing the test routine.

This procedure can be performed by a heat load calculated in Watts applied by the module to maintain predetermined temperatures such as 65K 1st stage and 13.5K 2nd stage at a set rpm of the motor/regenerators.

In some embodiments, the control circuitry will also provide an option to allow a service engineer to run a diagnostic Health check with parameters they choose by sending a special command to the module.

Regeneration is a process of warming the cryopanel surfaces with electric heaters located on the 1st and 2nd stages. $N_2$ gas is utilized to dilute $H_2$ gasses pumped into the charcoal of the 2nd stage on implant pumps. Then a rough/purge process is used to clean the cryopump stages at an increased temperature such as 310K and in some cases up to as high as 330K to liberate the trapped gasses out of the pressure relief valve to a gas scrubber.

The cryopump is then cooled to a set temperature, in one example 290K and evacuated to a set vacuum, for example ~50 microns, then to check the effectiveness of the evacuation a rate of rise test ROR is conducted until it has passed a predetermined value of say 10 microns per minute.

After the ROR is passed the motor is started and the cryopump cools to the base temperatures which in some examples such as implant pumps is 65K/13.5K and after performing the Health Check it is ready to be utilized by the user and it is "regen complete".

The cryopumps use a variable speed in some embodiments any speed between 30 and 144 rpm motor to drive the regenerators within the cylinder to utilize the helium expansion for cooling the dual "stages" of the refrigerator.

The revolutions per minute of the regenerators have a direct influence on the amount of cooling power or watts that the refrigerator can maintain at a set temperature.

A regeneration is described as the pump going through a set routine to warm, purge and evacuate the pump so it can be cooled down to operating temperatures the regen complete signals the customer it is ready for use.

This test routine will be run after regenerations and whenever a service engineer has access to the cryopump module and commands the test routine. Performance capabilities will be compared to previous tests to predict with the aid of service engineers the cryopump/system's performance.

Performance, dependability and safety are vital to user's of the pumps, thus being able to predict unexpected occurrences is paramount.

The health check routine is designed to look at the pump's performance over time and aid service engineers to identify possible degradation to this performance.

This allows the service engineers to visit the customer to diagnose the possible issues with the system to alleviate the issue. This may involve maintenance of the system or removal/repair of the pump/compressor or accessory prior to it disrupting the customer process and thereby reducing system tool down time.

The data collected during the test routine is stored in a data store associated with the pump and may be pulled from the data store by a service engineer or transmitted to a remote server that analyses the data in response to a signal received from the remote server requesting the data. The data may be analysed to determine both the current performance and changes in performance of the pump over time.

FIG. 1 shows a cryopump 5 according to an embodiment. Cryopump 5 is cooled by refrigeration unit 16 which is controlled by control and diagnostic circuitry 14. The refrigeration unit 16 comprises a cold finger extending into the cryopump vessel and comprises a first stage which cools the inner surface of the vessel and a frontal array (not shown) arranged across the inlet 7 and a second stage which cools the cryopanels 10 to a cooler temperature than the temperature of the first stage. The refrigerator comprises a variable speed motor 17 which drives the refrigerant, in this case helium around the refrigeration system.

There are heaters 18*a* and 18*b* associated with the first and second stage refrigerators respectively and these can be used to provide heat during regeneration and testing of the cryopump.

Cryopump 5 is used to evacuate a vacuum chamber to a high vacuum. The vacuum chamber may be used in, for example, semiconductor processing such as chip manufacture. The cryopump is a capture pump whereby gas molecules entering the cryopump are captured by condensing or adsorbing them on the cooled surfaces of the cryopump. This means that periodically the cryopump will need to be regenerated to remove the captured condensed gas.

Control circuitry 14 controls the operation of the cryopump and during regeneration of the cryopump will control the regeneration cycle. During the regeneration cycle the cryopump is isolated from the vacuum chamber generally by a gate valve and heaters 18*a*, 18*b* are used to increase the temperature of the cryopump while purge gases are input to remove any evaporated molecules. This regeneration is carried out periodically when the condensed matter in a pump rises above a value whereby the pump stops operating efficiently.

In addition to controlling the regeneration cycle, control and diagnostic circuitry 14 may be configured to perform a test routine upon completion of the regeneration cycle when the status of the cryopump is known. This test routine is used to determine the health or performance of the pump and allows degradation of the pump's performance to be monitored and failure of the pump predicted before it occurs. Unexpected failure of a pump can be very expensive particularly where the pump is used in chip manufacture and thus, predicting a failure in advance and allowing the pump to be swapped before it fails has many advantages.

The test routine is used to determine the current cooling capacity of the cryopump 5 when a motor within refrigeration unit 16 is operating at a constant speed. The motor within refrigeration unit 16 sends the refrigerant in this case helium around the refrigeration system and is generally a variable speed motor allowing the capacity of the pump and the cooling power to be changed. During the test routine the pump's speed is set to a predetermined value and the temperature sensors 12*a* and 12*b* are used to determine the temperatures of the first and second stage refrigerator and transmit the signals to circuitry 14. Circuitry 14 controls heaters 18*a* and 18*b* associated with the first and second stage refrigerator such that the temperature of the first and second stage refrigerators are maintained at certain predetermined values. These values may be selected as the normal operating temperature of the cryopump. The amount of power required by the heaters to maintain this temperature is indicative of the cooling power of the cryopump 5 and may be stored in a data store 13. A service engineer can then access this data store and determine the current performance and any changes in performance along with a rate of change in performance of the cryopump over time.

In some embodiments, there is also provided an input/output port 19 which may be used to output the current performance of the cryopump to an operator. This may be output as an indicator which may be accessed by the operator of the pump. This indicator may be a numerical value indicative of the current performance of the pump which may relate to a percentage of the optimum performance or it may simply be a colour indicative of whether the performance is currently good or not so good. In some cases it may contain an indication that a service engineer should be contacted. In other cases the data may be output via a transmitter to a remote server configured. This may occur in response to receipt of a request for the data from the remote server. The remote server may be a server configured to analyse data received from multiple pumps and to monitor their performance and any changes in performance from this data.

In some embodiments input/output port 19 may also be used to receive values input by a service engineer indicative of the motor speed and/or first and second stage temperatures to be used in the test routine. This allows these values to be updated as required. In this regard, depending on the operating conditions of the pump, different temperatures and/or motor speeds may be more appropriate for the testing of the pump.

Figure 2:
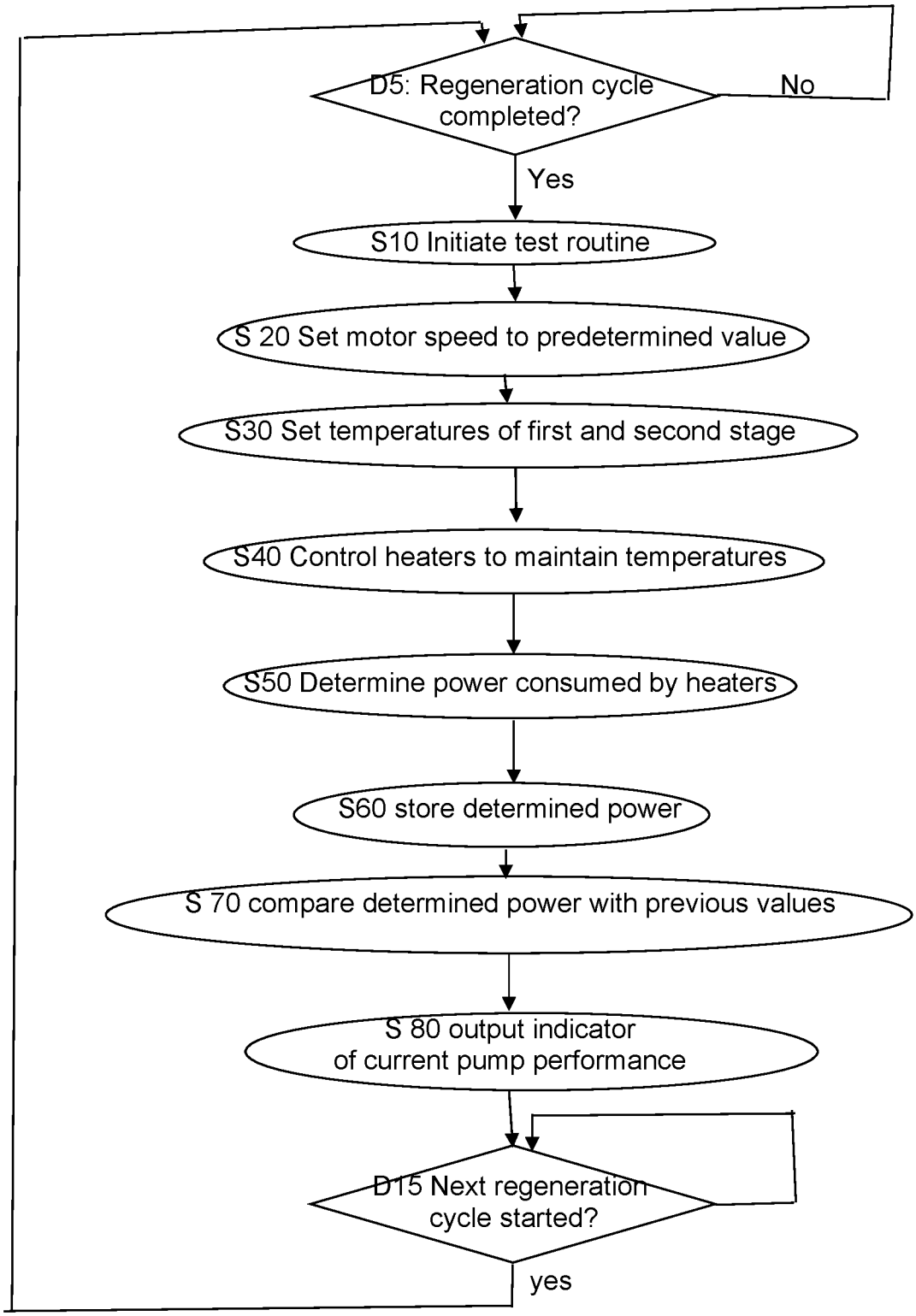
FIG. 2 shows a flow diagram illustrating steps in a method according to an embodiment.

FIG. 2 shows a flow diagram illustrating steps in a method of monitoring the performance or health of the pump according to an embodiment. Initially at step D5 it is determined whether a regeneration cycle has completed or not.

When it is determined that it has completed a test routine is initiated at step S10. In this regard, in some embodiments instead of S10 being performed after each regeneration cycle, it may only be initiated after completion of a certain number of regeneration cycles. In which case there may be an intermediate step to determine whether a counter has counted up to this certain number, the counter being incremented after each regeneration cycle has completed.

Once the test routine has been initiated then at step S20 the speed of the motor is set to a predetermined value and cooling of the cryopump starts. The temperatures of the first and second stage are set to a predetermined value in step S30. The predetermined temperatures and speed of the motor may be set values in the control/diagnostic circuitry, and/or they may be values that may be updated in response to an input by a service engineer. In step S40 the heaters are controlled to maintain the temperature of the first and second stage refrigerators at the desired predetermined temperatures. The power consumed by the heaters to maintain the temperatures is indicative of the current performance of the cryopump and thus, in step S50 the power applied to and consumed by the heaters is determined and this value is stored as an indication of the performance of the pump in step S60. This value may be stored alongside an indication of the regeneration cycle that the test routine from which the value was derived was performed after.

At S70 the current power may be compared with previous values to determine a change and/or a rate of change in the performance of the pump. This alongside the actual determined power value can be used to determine the current pump performance. In some embodiments an indicator of current performance may be output at step S80. The regeneration cycle and testing of the pump is now complete and normal operation is resumed. The diagnostic circuitry then proceeds to determine when the next regeneration cycle has started at step D15 and when it has it waits until the cycle has completed before it may again initiate the test routine at S10.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A method comprising:

following completion of a regeneration cycle controlling said cryopump to perform a predetermined test routine for testing a performance of said cryopump under predetermined conditions wherein said step of controlling said cryopump to perform a predetermined test routine comprises:

controlling a variable speed motor controlling a flow of refrigerant through a refrigerating system of said cryopump to operate at a predetermined speed so as to cool a first stage of the refrigerator and a second stage of the refrigerator;

setting a first predetermined temperature for said first stage of a refrigerator and a second predetermined temperature for a second stage of said refrigerator;

while said refrigerating system is cooling said first stage and said second stage, controlling heaters associated with said first and second stages of said refrigerator such that said first and second predetermined temperatures are maintained; and determining a power consumed by the heaters and comparing the determined power with a previous power value to provide an indication of the performance of said cryopump.

2. The method according to claim 1, said method controlling said cryopump to perform said predetermined test routine periodically after at least a subset of said regeneration cycles.

3. A control circuitry for a cryopump, said control circuitry being configured to determine when a regeneration cycle has completed and to control said cryopump following completion of said regeneration cycle to perform a predetermined test routine for testing a performance of said cryopump under predetermined conditions wherein said predetermined test routine comprises:

controlling a variable speed motor controlling a flow of refrigerant through a refrigerating system of said cryopump to operate at a predetermined speed so as to cool a first stage of the refrigerator and a second stage of the refrigerator;

setting a first predetermined temperature for said first stage of a refrigerator and a second predetermined temperature for a second stage of said refrigerator;

while said refrigerating system is cooling said first stage and said second stage, controlling heaters associated with said first and second stages of said refrigerator such that said first and second predetermined temperatures are maintained; and determining a power consumed by the heaters and comparing the power to a previous power value to provide an indication of the performance of said cryopump.

4. The control circuitry according to claim 3, said control circuitry being configured to control said cryopump to perform said predetermined test routine periodically after at least a subset of said regeneration cycles.

5. A cryopump comprising:

a refrigerator unit;

a variable speed motor for controlling a flow of refrigerant through a cooling system of said cryopump; and control circuitry according to claim 3.

* * * * *